US009524694B2

(12) United States Patent
Wang et al.

(10) Patent No.: US 9,524,694 B2
(45) Date of Patent: Dec. 20, 2016

(54) DISPLAY WITH SPATIAL AND TEMPORAL REFRESH RATE BUFFERS

(71) Applicant: Apple Inc., Cupertino, CA (US)

(72) Inventors: Chaohao Wang, Cupertino, CA (US); Cheng Chen, San Jose, CA (US); Shih-Chyuan Fan Jiang, Taipei (TW); Zhibing Ge, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 113 days.

(21) Appl. No.: 14/527,672

(22) Filed: Oct. 29, 2014

(65) Prior Publication Data

US 2016/0125785 A1 May 5, 2016

(51) Int. Cl.

| | |
|---|---|
| ***G09G 3/20*** | (2006.01) |
| ***G09G 3/36*** | (2006.01) |
| ***G09G 3/34*** | (2006.01) |
| ***G09G 5/00*** | (2006.01) |
| ***G09G 5/02*** | (2006.01) |
| ***G09G 5/391*** | (2006.01) |

(52) U.S. Cl.

CPC ..... *G09G 5/02* (2013.01); *G09G 3/3648* (2013.01); *G09G 5/001* (2013.01); *G09G 5/391* (2013.01); *G09G 2320/103* (2013.01); *G09G 2340/0435* (2013.01)

(58) Field of Classification Search

CPC ..... G09G 2330/021; G09G 2320/041; G09G 2320/043; G09G 3/20; G09G 2300/0842

See application file for complete search history.

(56) References Cited

U.S. PATENT DOCUMENTS

| | | | | |
|---|---|---|---|---|
| 8,477,846 | B2 | 7/2013 | Vadapalli et al. | |
| 8,581,923 | B2 | 11/2013 | Kerofsky | |
| 8,842,111 | B2 | 9/2014 | Kambhatla et al. | |
| 2010/0277641 | A1* | 11/2010 | Kato | G09G 3/3648 348/441 |
| 2013/0033477 | A1* | 2/2013 | Sirpal | G06F 1/1616 345/211 |
| 2014/0015816 | A1* | 1/2014 | Janus | G09G 3/00 345/204 |
| 2014/0104243 | A1* | 4/2014 | Sakariya | G06F 3/14 345/204 |
| 2014/0198138 | A1* | 7/2014 | Nambi | G09G 3/36 345/690 |

(Continued)

FOREIGN PATENT DOCUMENTS

WO 2013190144 12/2013

*Primary Examiner* — Todd Buttram

(74) *Attorney, Agent, or Firm* — Treyz Law Group, P.C.; G. Victor Treyz; Joseph F. Guihan

(57) ABSTRACT

A display may have an array of pixels. The display may be controlled using display driver circuitry. The display driver circuitry may analyze image data to be displayed on the array. When static content is detected, the rate at which the pixels are refreshed may be adjusted to conserve power. If a static image is detected, the gate lines may be asserted at a lower refresh rate than if moving content is detected. To avoid visible artifacts, the display driver circuitry may use temporal and spatial refresh rate buffers. Temporal buffers ensure that refresh rates are changed gradually as a function of time, thereby minimizing flicker. Spatial refresh rate buffers are used to provide a smooth transition between low refresh rate and high refresh rate regions in a display as a function of position.

4 Claims, 7 Drawing Sheets

(56) References Cited

U.S. PATENT DOCUMENTS

| | | | | |
|---|---|---|---|---|
| 2014/0204114 | A1 | 7/2014 | Zeng et al. | |
| 2014/0253694 | A1* | 9/2014 | Zustak | H04N 13/0018 348/51 |
| 2016/0042708 | A1* | 2/2016 | Wang | G09G 3/32 345/214 |

* cited by examiner

DISPLAY WITH SPATIAL AND TEMPORAL REFRESH RATE BUFFERS

BACKGROUND

This relates generally to displays, and, more particularly, to variable refresh rate displays.

Electronic devices often include displays. Display driver circuitry is used to apply control signals to an array of pixels in a display. The array of pixels is used to display images for a user. In a liquid crystal display, for example, each pixel includes an electrode for applying a controllable electric field to a pixel-sized region of liquid crystal material. A thin-film transistor in each pixel is used to pass a data signal to the pixel from a data line in the display. There is a capacitance associated with the pixel-sized region of liquid crystal material and a storage capacitor is coupled in parallel with this capacitance to ensure that the pixel is able to store data signals between successive image frames.

The process of using the display driver circuitry to display images on the array of pixels in a display consumes power. Between frames, charge leaks out of each pixel. The capacitances in each pixel are refreshed each frame. Power is consumed in proportion to the refresh rate of the display as pixels are discharged and charged.

To help conserve power, some displays implement variable refresh rate schemes. When the display is being used normally, the display is refreshed at a high refresh rate. When it is desired to conserve power, the display is refreshed at a low refresh rate.

It can be challenging to implement a variable refresh rate scheme. If care is not taken, the display may exhibit undesirable visible artifacts such as transient flickering when transitioning between different refresh rates.

It would therefore be desirable to be able to provide improved techniques for controlling refresh rates in displays.

SUMMARY

A display may have an array of pixels. Columns of the array may have data lines that are provided with data signals. Rows of the array may have gate lines. Gate line driver circuitry may assert gate line signals on the gate lines to load data from the data lines into respective rows of the pixels in the array. The pixels may include storage capacitors that maintain a desired data signal level between successive assertions of the gate lines signals to refresh the data.

The display may be controlled using display driver circuitry. The display driver circuitry may analyze image data to be displayed on the array. When static content is detected, the rate at which the pixels are refreshed may be reduced to conserve power. For example, if a static image is detected, the gate lines may be asserted at a lower refresh rate than if moving content is detected.

To avoid visible artifacts, the display driver circuitry may use temporal and spatial refresh rate buffers. Temporal buffers ensure that refresh rates are changed gradually as a function of time, thereby minimizing flicker. Temporal buffers may involve the use of one or more intermediate refresh rates to smooth refresh rate transitions when decreasing and increasing the refresh rate of a display.

Spatial refresh rate buffers are used to provide a smooth transition between low refresh rate and high refresh rate regions in a display. High refresh rates may be used to ensure that moving content is displayed satisfactorily. Low refresh rates may be used in regions of the display that contain static content. In a spatial refresh rate buffer region, one or more intermediate refresh rates may be used. The spatial refresh rate buffer may be interposed between the high and low refresh rate regions to ensure that changes in display luminance are gradual and unnoticeable by a user.

DETAILED DESCRIPTION

Figure 1:
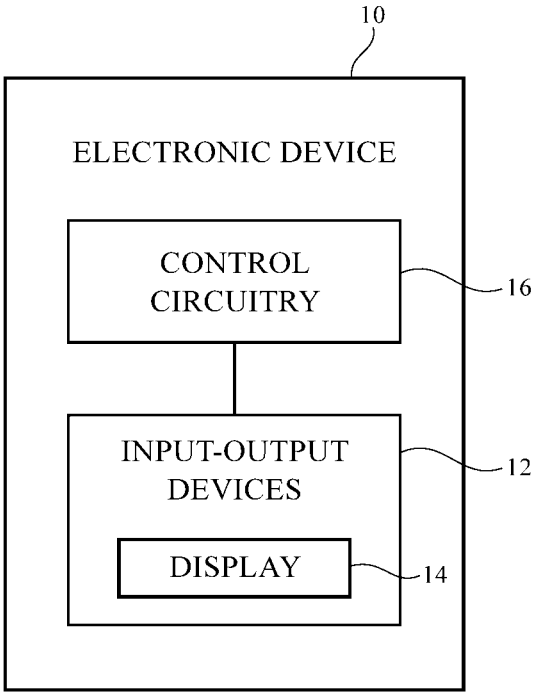
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications.

During operation of device 10, the software running on control circuitry 16 may display images on display 14.

Display 14 may be a liquid crystal display, an organic light-emitting diode display, an electrophoretic display, an electrowetting display, or any other suitable type of display. Configurations in which display 14 is a liquid crystal display are sometimes described herein as an example. This is, however, merely illustrative. Any suitable type of display may be used, if desired.

Figure 2:
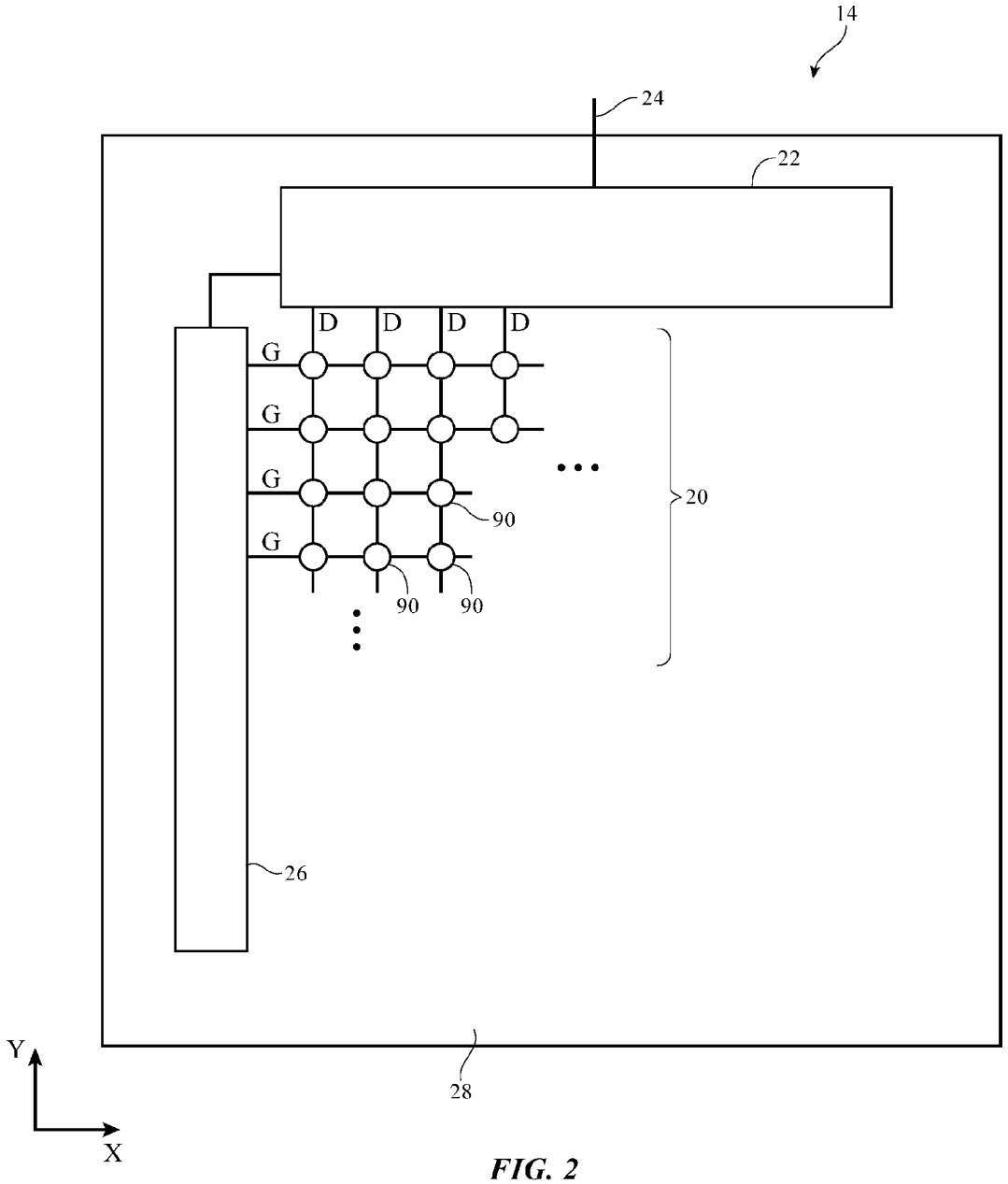
FIG. 2 is a diagram of an illustrative display in accordance with an embodiment.

As shown in FIG. 2, display 14 may include layers such as substrate layer 28. Substrate layers such as layer 28 may be formed from planar rectangular layers of material such as planar glass layers, planar polymer layers, composite films that include polymer and inorganic materials, metallic foils, etc. Substrate 28 may have left and right vertical edges and upper and lower horizontal edges. If desired, substrates such as substrate 28 may have non-rectangular shapes (e.g., shapes with curved edges, etc.).

Display 14 may have an array of pixels 90 for displaying images for a user such as pixel array 20. Pixels 90 in array 20 may be arranged in rows and columns. There may be any suitable number of rows and columns in array 20 (e.g., ten or more, one hundred or more, or one thousand or more). Display 14 may include pixels 90 of different colors. As an example, display 14 may include red pixels, green pixels, and blue pixels. If desired, a backlight unit may provide backlight illumination for display 14.

Display driver circuitry may be used to control the operation of pixels 90. The display driver circuitry may be formed from integrated circuits, thin-film transistor circuits, or other suitable circuitry. The display driver circuitry of FIG. 2 includes display driver circuitry 22 and gate driver circuitry 26. Gate driver circuitry 26 may be formed along one or more edges of display 14. For example, gate driver circuitry 26 may be arranged along the left edge of display 14 as shown in FIG. 2 or may be arranged along the opposing right and left edges of a display (as an example).

As shown in FIG. 2, display driver circuitry 22 (e.g., one or more display driver integrated circuits, thin-film transistor circuitry, etc.) may contain communications circuitry for communicating with system control circuitry over path 24. Path 24 may be formed from traces on a flexible printed circuit or other cable. The control circuitry may be located on one or more printed circuits in electronic device 10. During operation, the control circuitry (e.g., control circuitry 16 of FIG. 1) may supply circuitry such as a display driver integrated circuit in circuitry 22 with image data for images to be displayed on display 14.

To display the images on display pixels 90, display driver circuitry 22 may supply corresponding image data to data lines D while issuing control signals to supporting display driver circuitry such as gate driver circuitry 26. With the illustrative arrangement of FIG. 2, data lines D run vertically through display 14. Data lines D are associated with respective columns of display pixels 90.

Gate driver circuitry 26 (sometimes referred to as gate line driver circuitry) may be implemented as part of an integrated circuit and/or may be implemented using thin-film transistor circuitry on substrate 28. Gate lines G (sometimes referred to as scan lines or horizontal control lines) run horizontally through display 14. Each gate line G is associated with a respective row of pixels 90. If desired, there may be multiple horizontal control lines such as gate lines G associated with each row of pixels. The configuration of FIG. 2 in which each gate line G is associated with a respective row of pixels 90 is merely illustrative.

Gate driver circuitry 26 may assert control signals on the gate lines G in display 14. For example, gate driver circuitry 26 may receive clock signals and other control signals from circuit 22 and may, in response to the received signals, assert a gate line signal on gate lines G in sequence, starting with the gate line signal G in the first row of pixels 90 in array 20. As each gate line is asserted, data from data lines D is located into the corresponding row of pixels. In this way, control circuitry such as display driver circuitry 22 and 26 may provide pixels 90 with signals that direct pixels 90 to display a desired image on display 14.

Figure 3:
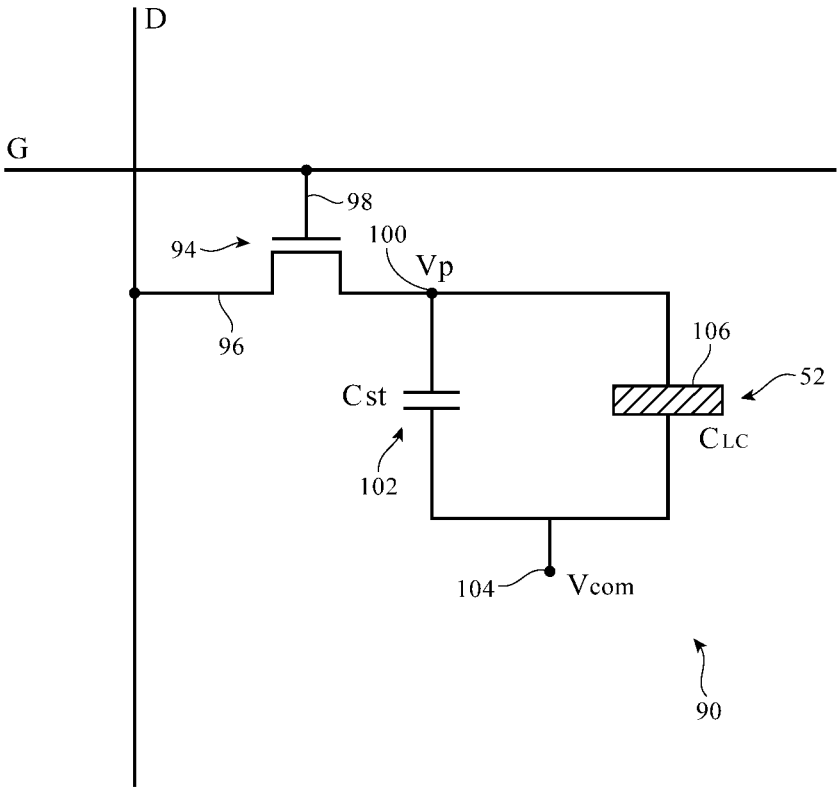
FIG. 3 is a diagram of an illustrative pixel circuit in a display in accordance with an embodiment.

As shown in FIG. 3, pixels such as pixel 90 may be located at the intersection of each gate line G and data line D in array 20. A data signal on each data line D may be supplied to terminal 96 of thin-film transistor 94 from one of data lines D. Thin-film transistor 94 (e.g., a thin-film polysilicon transistor, an amorphous silicon transistor, a semiconducting oxide transistor, etc.) may have a gate terminal such as gate 98 that receives gate line control signals on gate line G. When a gate line control signal is asserted, transistor 94 will be turned on and the data signal at terminal 96 will be passed to node 100 as voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to store signal Vp in pixel 90 between frames (i.e., in the period of time between the assertion of successive gate signals).

Display 14 may have a common electrode coupled to node 104. The common electrode (which is sometimes referred to as the Vcom electrode or Vcom terminal) may be used to distribute a common electrode voltage such as common electrode voltage Vcom to nodes such as node 104 in each pixel 90. In each pixel 90, capacitor 102 may be coupled between nodes 100 and 104. A parallel capacitance (sometimes referred to as capacitance CO arises across nodes 100 and 104 due to electrode structures in pixel 90 that are used in controlling the electric field through the liquid crystal material of the pixel (liquid crystal material 52).

As shown in FIG. 3, electrode structures 106 (e.g., a pixel electrode with multiple fingers or other pixel electrode for applying electric fields to liquid crystal material 52) may be coupled to node 100 (or a multi-finger display pixel electrode may be formed at node 104). The capacitance $C_{LC}$ across liquid crystal material 52 is associated with the capacitance between electrode structures 106 and common electrode Vcom at node 104.

During operation, electrode structures 106 may be used to apply a controlled electric field (i.e., a field having a magnitude proportional to Vp-Vcom) across a pixel-sized portion of liquid crystal material 52 in pixel 90. Due to the presence of storage capacitor 102 and the capacitance $C_{LC}$ of material 52 in pixel 90, the value of Vp (and therefore the associated electric field across liquid crystal material 52') may be maintained across nodes 106 and 104 for the duration of the frame. The rate at which data is loaded into the array (e.g., the rate at which frames are displayed) affects how often the data on the data lines is used to refresh the data voltage Vp on nodes 100 and is therefore sometimes referred to as the refresh rate of the array.

The electric field that is produced across liquid crystal material 52 causes a change in the orientations of the liquid crystals in liquid crystal material 52. This changes the polarization of light passing through liquid crystal material 52. The change in polarization may, in conjunction with upper and lower polarizers in display 14, be used in controlling the amount of light that is transmitted through each pixel 90 in array 20 of display 14.

Leakage currents may cause the amount of charge that stored on the capacitance of each pixel (i.e., storage capacitor Cst and parallel capacitance CO to drain away over time. In a variable refresh rate display, this causes the voltage Vp to decline more when a slower pixel refresh rate is used than when a faster pixel refresh rate is used. If care is not taken, an abrupt change in refresh rate will produce noticeable flickering on display 14.

Figure 4:
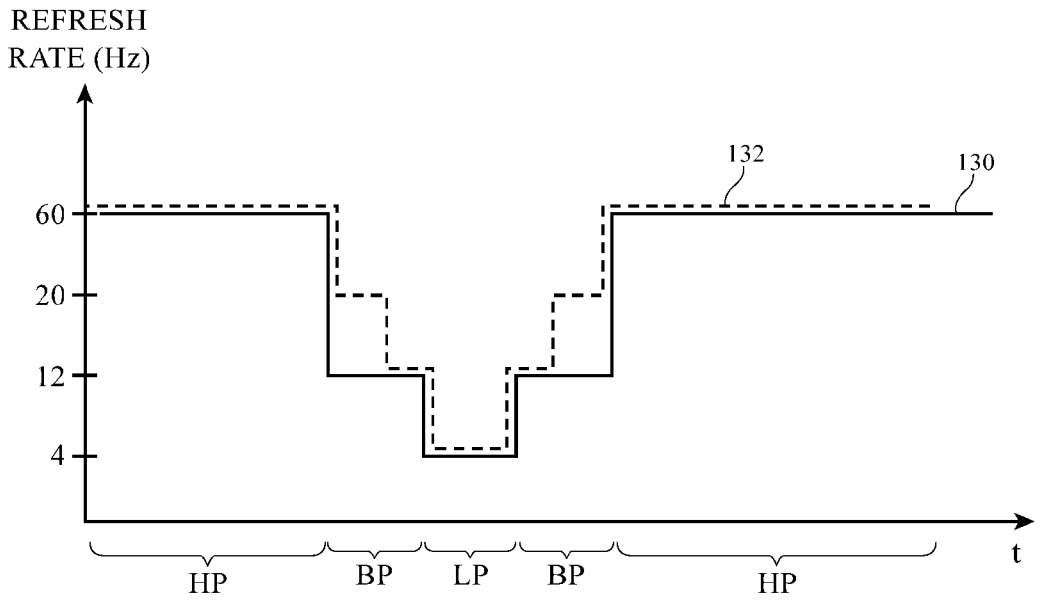
FIG. 4 is a graph showing how refresh rate changes may be made to minimize flickering in accordance with an embodiment.

To avoid undesired flickering, display 14 may adjust the refresh rate of display 14 gradually using temporal refresh rate buffers. This approach is illustrated in the example of FIG. 4. In the graph of FIG. 4, the refresh rate of display 14 (in Hz) is plotted as a function of time (t). Two illustrative refresh rate adjustment curves are illustrated in the graph of FIG. 4. With the approach illustrated by curve 130, the display driver circuitry of display 14 initially adjusts the refresh rate of display 14 to be 60 Hz. This refresh rate is used for high rate period HP. During low refresh rate period LP, the refresh rate of display 14 is reduced to a lower value such as 4 Hz (or 1 Hz or other suitable low rate that is desired to conserve power). When normal operation is desired, the original high refresh rate of 60 Hz (or other suitable rate) can be resumed for another high refresh rate period HP.

Reducing the refresh rate abruptly from 60 Hz to 4 Hz has the potential to create visible flickering. The likelihood of flickering can be reduced or eliminated by using one or more intermediate refresh rates in buffer periods around low refresh rate period LP. For example, a buffer refresh rate period BP may be interposed between low refresh rate period LP and preceding and succeeding high rate periods HP. There may be any suitable number of refresh rate steps in buffer period BP.

In the example associated with curve 130, there is a single intermediate refresh rate of 12 Hz that is used in buffer refresh rate periods BP. When a single intermediate refresh rate of 12 Hz is used, display 14 initially operates at 60 Hz, then operates at a reduced rate of 12 Hz, before being reduced to the rate of 4 Hz. When resuming normal operation, the refresh rate is adjusted upward to 12 Hz before being increased to normal refresh rate 60 Hz.

In the example associated with curve 132, there are multiple refresh rates of 20 Hz and 12 Hz that are used in each buffer period BP. When two intermediate refresh rates are used (e.g., 20 Hz and 12 Hz), display 14 may be operated normally at 60 Hz during period HP. During buffer period BP, the refresh rate may be reduced to 20 Hz, followed by a reduction to 14 Hz. The rate may be reduced again from 14 Hz to the low period rate of 4 Hz (or 1 Hz or other suitable low refresh rate). Normal operation may be resumed by increasing the rate to 12 Hz, then 20 Hz, and then 60 Hz. If desired, the entering buffer period BP and the exiting buffer period BP may contain different numbers of intermediate refresh rates and different intermediate refresh rate values. The use of symmetrical refresh rate buffer profiles in the examples of FIG. 4 is merely illustrative.

When a smaller number of buffer period steps are used (e.g., when only a single intermediate refresh rate is used), there is a larger risk of flickering, but the time taken to complete the transition between high and low refresh rates may be minimized. The inclusion of intermediate refresh rates in the refresh rate buffer period helps smooth visible changes in display luminance and reduces the likelihood of visible flicker being noticed by a user of device 10.

In addition to or instead of using temporal refresh rate buffers such as buffers BP of FIG. 4, spatial refresh rate buffers may be used. In a spatial refresh rate buffering scheme, display 14 has multiple areas each of which has a different refresh rate. For example, display may have one or more areas that contain moving content such as animated icons, video clips, moving or changing graphics, or other content in which a rapid refresh rate is desirable for optimum viewing. In these regions, the refresh rate of display 14 may be relatively high (e.g., 60 Hz). In other areas of the display, such as background regions or portions of the display that contain other static content, the refresh rate of display 14 may be relatively low (e.g., 1 Hz). To ensure that changes in the refresh rate from region to region of the display are sufficiently gradual, refresh rate buffer regions may be created that use intermediate refresh rates. Because the change in luminance between any two adjacent regions is reduced when buffer regions are used, visible artifacts (e.g., spatial variations in luminance) will not be noticeable to a user.

Figure 5:
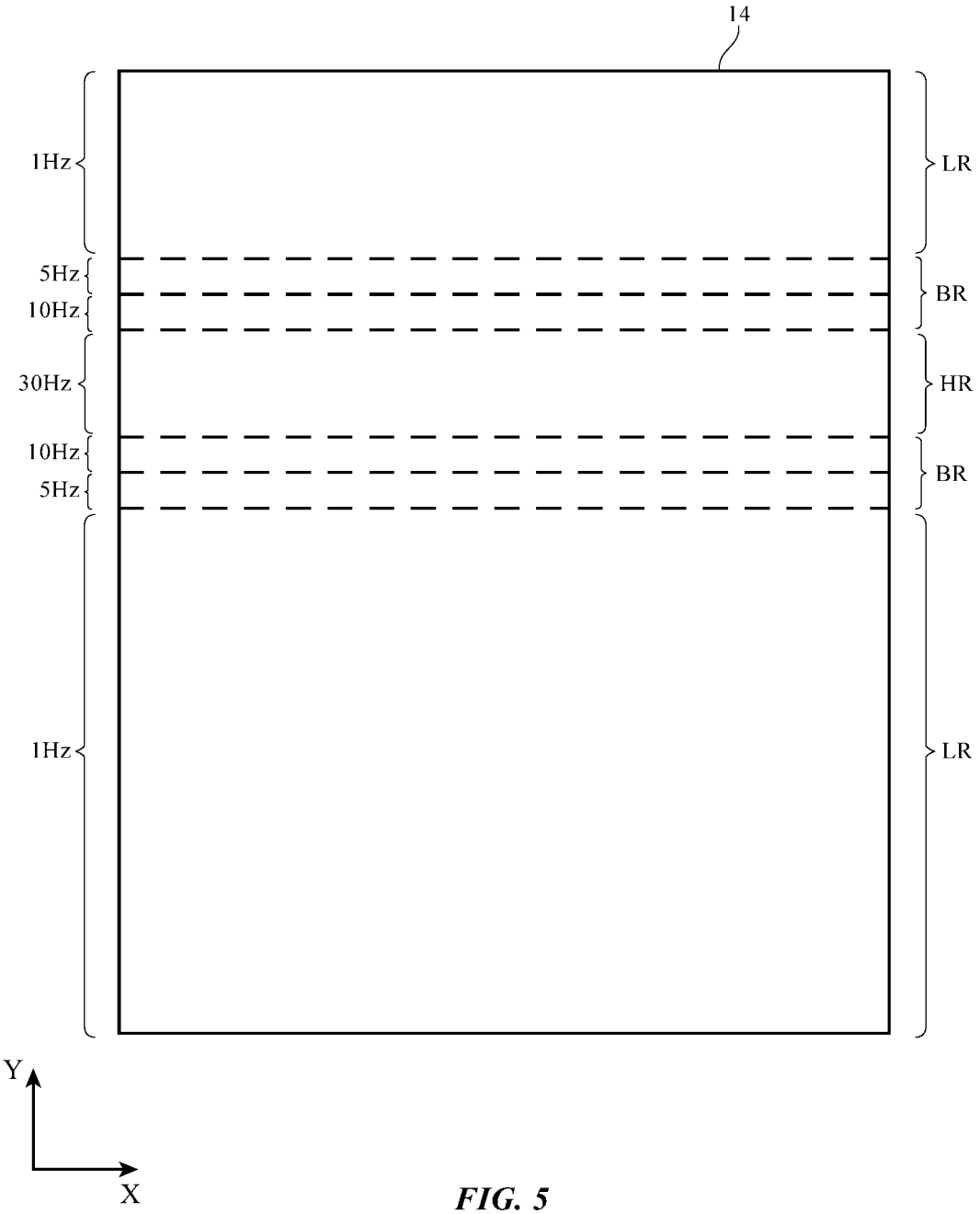
FIG. 5 is a diagram of a display with spatially varying refresh rates in accordance with an embodiment.

Consider, as an example, the scenario of FIG. 5. With the illustrative configuration of FIG. 5, display 14 has a high refresh rate region HR in which pixels 90 are refreshed at a rate of 30 Hz (as an example). Display 14 also has low refresh rate regions LR in which pixels 90 are static and are therefore refreshed at a low rate of 1 Hz (as an example). If the regions HR and LR were directly adjacent to each other, a user might be able to perceive a change in luminance between these two regions. In the presence of one or more intermediate buffer regions BR, however, luminance changes will not be as noticeable, because any changes in luminance will happen gradually as a function of position across the display.

There may be any suitable number of high refresh rate regions HR on display 14, any suitable number of low refresh rate regions LR on display 14, and any suitable number of intervening intermediate refresh rate buffer regions BR on display 14. Each buffer region BR may contain one or more different areas with one or more different respective refresh rates. When buffer regions BR contain a larger number of intermediate refresh rates, spatial changes in luminance will be more gradual. When buffer regions BR contain a smaller number of intermediate refresh rates display complexity may be minimized.

In the illustrative example of FIG. 5, buffer regions BR each contain a first region that is refreshed at a refresh rate of 5 Hz and a second region that is refreshed at a refresh rate of 10 Hz. The 5 Hz refresh rate area is located adjacent to the low refresh rate region LR and the 10 Hz refresh rate area is located adjacent to the high refresh rate region HR to provide a gradual change in refresh rate. In general, each buffer region BR may use a single intermediate refresh rate (e.g., a rate between that of region LR and that of region HR), may use two different intermediate refresh rates (as shown in the example of FIG. 5), or may use more than two different intermediate refresh rates.

In a rectangular display such as display 14 of FIG. 5 in which gate lines G extend across rows of pixels 90 in array 20, it may be desirable to configure the regions of display 14 with different refresh rates using a pattern of strip-shaped regions. For example, regions such as regions LR, BR, and HR may have the shape of elongated rectangular strips that extend horizontally along dimension X (i.e., each of these regions may have a longitudinal axis that extends parallel to axis X). In this type of configuration, changes in refresh rate occur as a function of changes in position along vertical dimension Y. Other types of patterns may be used for the regions of different refresh rates. The configuration of FIG. 5 is merely illustrative.

Figure 6:
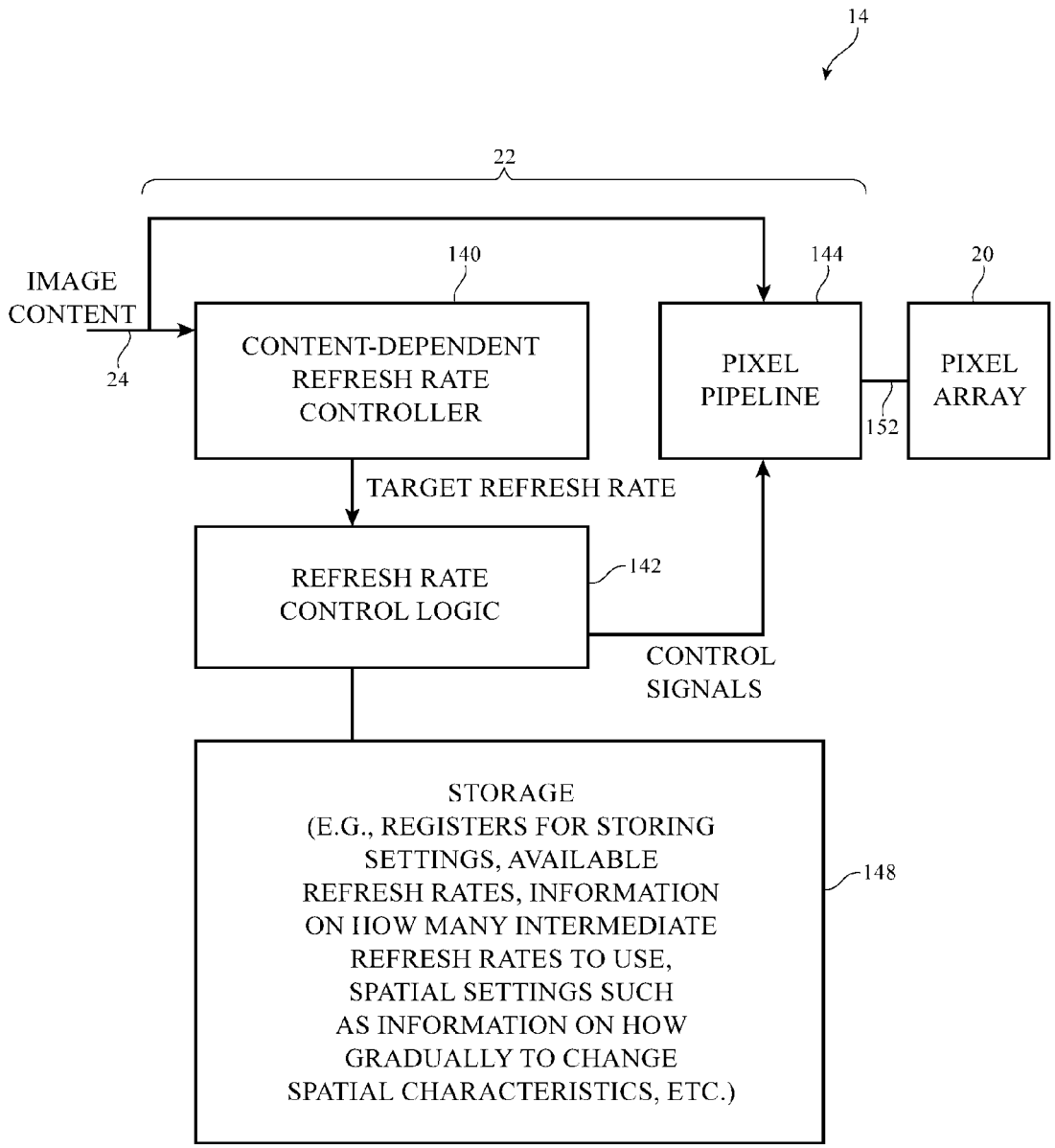
FIG. 6 is a diagram of circuitry involved in temporally and spatially controlling refresh rates in a display in accordance with an embodiment.

FIG. 6 is a diagram of illustrative circuitry that may be used in display 14 to implement temporal and/or spatial refresh rate buffering schemes. As shown in FIG. 6, display 14 may receive image data at input 24 of display driver circuitry 22. Display driver circuitry 22 may analyze the image content that is received from input 24 and may generate corresponding data and control signals for pixel array 20. The data and control signals may be provided to array 20 over signal path 152 and may include gate line signals G, clock signals, data signals D, and other signals for operating pixel array 20.

The signals that are provided to array 20 over path 152 refresh pixels 90 of array 20 using a mixture of different refresh rates. Refresh rates may be adjusted as a function of time and/or as a function of position within array 20. Corresponding temporal and/or spatial refresh rate buffers may be used to ensure that refresh rate changes are gradual in time and/or position on display 14, thereby minimizing visual artifacts such as flickering or position-based luminance variations across the surface of display 14.

Display driver circuitry 22 may include content-dependent refresh rate controller 140, refresh rate control logic 142, storage 148, and pixel pipeline 144. During operation, content-dependent refresh rate controller 140 may analyze image data from control circuitry 16 (FIG. 1) to produce information such as target refresh rate information for some or all of the portions of display 14. If, for example, controller 140 detects only static content in the image data that is to be displayed on display 14, a target refresh rate for display 14 may be set to a relatively low value (e.g., 1 Hz or 4 Hz) to conserve power. If controller 140 detects static content in one region of an image and moving content in another region of the image, controller 140 may produce a first target refresh rate (e.g., a low rate) for the static content region and a second target refresh rate (e.g., a high rate) for the portion of display 14 that has the moving content.

Storage 148 may include registers and other memory for storing display settings. The information stored within storage 148 may include, for example, a list of which refresh rates are available for display 14, information on available buffers (e.g., temporal buffer profiles, available spatial buffer regions, buffer characteristics such as available refresh rates as functions of time and/or position, etc.), information on which types of buffers should be deployed as a function of different high refresh rate and low refresh rate settings (e.g., information on how many intermediate refresh rates should be used in a temporal buffer as a function of the refresh rate difference between the maximum and minimum desired refresh rates, information on how many intermediate refresh rates should be used in a spatial buffer region as a function of the maximum and minimum refresh rate, etc.).

Pixel pipeline 144 receives image data from input 24 and control signals from refresh rate control logic 142. The control signals may include a desired current refresh rate for all of array 20 and/or current refresh rates for different regions of array 20 (i.e., when spatially varying refresh rates are used). Pixel pipeline 144 may produce signals on path 152 based on the image data received from input 24 and the control signals received from refresh rate control logic 142.

Refresh rate control logic 142 produces the control signals for pixel pipeline 144 based on information such as the target refresh rate information from content-dependent refresh rate controller 140 and settings information from storage 148. Consider, as an example, a scenario in which the current refresh rate is 60 Hz and in which static content is provided to input 24. In this scenario, controller 140 may produce a target refresh rate of 1 Hz. Storage 148 may contain settings that indicate that a temporal buffer with two intermediate refresh rates of 20 Hz and 12 Hz should be used when lowering the refresh rate from 60 Hz to 1 Hz. In this type of illustrative scenario, refresh rate control logic 142 will supply control signals to pixel pipeline 144 that gradually reduce the refresh rate from 60 Hz, to 20 Hz, to 12 Hz, and finally to 1 Hz (i.e., logic 142 will implement a temporal refresh rate buffer of the type shown by curve 132 of FIG. 4).

Figure 7:
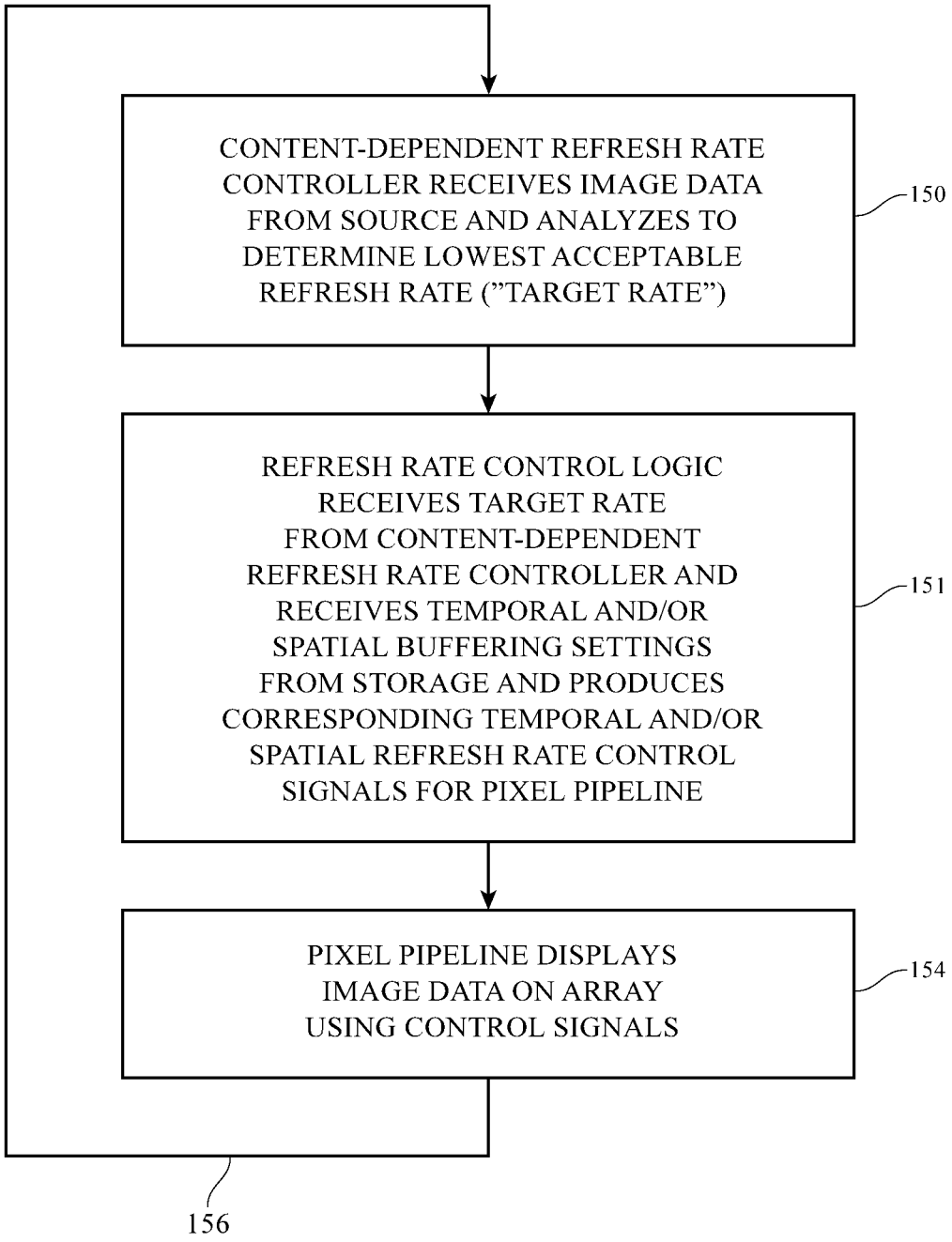
FIG. 7 is a flow chart of illustrative steps involved temporally and spatially controlling refresh rates in a display in accordance with an embodiment.

FIG. 7 is a flow chart of illustrative steps involved in operating a variable refresh rate display using temporal and/or spatial refresh rate buffers to minimize power consumption while avoiding undesired visual artifacts.

At step 150, content-dependent refresh rate controller 140 may receive image data for images that are to be displayed on pixel array 20 of display 14. The image data may be provided by an image data source such as control circuitry 16 of FIG. 1. Controller 140 may analyze the image data to identify regions of low and/or high activity (e.g., static content regions or regions with slowly varying content and regions with other non-static content). In regions with static content, a lowered pixel refresh rate is appropriate and can be used to conserve power. In regions with non-static content, higher refresh rates are appropriate to avoid creating visual delays when displaying content. The refresh rate(s) that are identified as being appropriate for one or more regions of display 14 are sometimes referred to as target refresh rates. Controller 140 supplies these target refresh rates to refresh rate control logic 142.

At step 151, refresh rate control logic 142 receives the target refresh rate(s) from controller 140 and uses information from storage 148 such as buffer settings and information on display capabilities to produce corresponding pixel pipeline control signals for pixel pipeline 144.

At step 154, pixel pipeline 144 creates output signal on path 152 that display the image data from input 24 on pixel array 20. The output signal that is produced by pixel pipeline 144 may be based on image data for input 24 and control signals from logic 142. Temporal and/or spatial buffers are used to ensure that visual artifacts are minimized.

As indicated by line 156, the operations of FIG. 7 may be performed continuously while device 10 is displaying content on display 14.

The foregoing is merely illustrative and various modifications can be made by those skilled in the art without departing from the scope and spirit of the described embodiments. The foregoing embodiments may be implemented individually or in any combination.

What is claimed is:

1. A method, comprising:

processing image data with display driver circuitry in a display to identify refresh rate buffers to use in refreshing pixels in an array of pixels; and with the display driver circuitry, refreshing pixels in the array of pixels at a first refresh rate, a second refresh rate that is different that the first refresh rate, and at least one intermediate refresh rate associated with an identified refresh rate buffer, wherein the at least one intermediate refresh rate is between the first and second refresh rates, wherein the identified refresh rate buffer comprises a temporal refresh rate buffer and wherein refreshing the pixels comprises:

refreshing the pixels in the array at the first refresh rate during a first time period, refreshing the pixels in the array at the second refresh rate during a second time period, and refreshing the pixels in the array at the at least one intermediate refresh rate during the temporal refresh rate buffer between the first and second time periods, wherein an amount of intermediate refresh rates that are included in the at least one intermediate refresh rate is determined based on a rate difference between the first refresh rate and the second refresh rate.

2. A method of operating an array of pixels that displays images based on image data, comprising:

processing the image data with display driver circuitry in a display;

identifying static content in a first portion of the array;

identifying moving content in a second portion of the array;

refreshing pixels in the first portion of the array at a minimum refresh rate;

refreshing pixels in the second portion of the array at a maximum refresh rate;

based on a difference between the maximum refresh rate and the minimum refresh rate, determining an amount of intermediate refresh rates to be used in a spatial buffer region of the array, wherein the spatial buffer region of the array is interposed between the first portion of the array and the second portion of the array; and refreshing pixels in the spatial buffer region of the array at the intermediate refresh rates.

3. The method defined in claim 2, wherein determining the amount of intermediate refresh rates to be used in the spatial buffer region of the array comprises determining that one intermediate refresh rate will be used in the spatial buffer region of the array.

4. The method defined in claim 2, wherein determining the amount of intermediate refresh rates to be used in the spatial buffer region of the array comprises determining that two intermediate refresh rates will be used in the spatial buffer region of the array, wherein the two intermediate refresh rates comprise first and second intermediate refresh rates, wherein the second intermediate refresh rate is greater than the first intermediate refresh rate, wherein refreshing the pixels in the spatial buffer region of the array at the intermediate refresh rates comprises refreshing a first portion of the spatial buffer region of the array at the first intermediate refresh rate, wherein refreshing the pixels in the spatial buffer region of the array at the intermediate refresh rates comprises refreshing a second portion of the spatial buffer region of the array at the second intermediate refresh rate, wherein the first portion of the spatial buffer region is adjacent to the first portion of the array, and wherein the second portion of the spatial buffer region is adjacent to the second portion of the array.

* * * * *